US006637352B1

(12) United States Patent
Thode et al.

(10) Patent No.: US 6,637,352 B1
(45) Date of Patent: Oct. 28, 2003

(54) TABLE WITH PIVOTABLE TABLE-TOP

(75) Inventors: Jürgen Thode, Wülfrath (DE); Andreas Störiko, Milan (IT); Heinrich Iglseder, Rodenberg (DE)

(73) Assignee: Wilkhahn Wilkening + Hahne GmbH + Co., Hannover (DE)

( * ) Notice: Subject to any disclaimer, the term of this patent is extended or adjusted under 35 U.S.C. 154(b) by 0 days.

(21) Appl. No.: 10/049,075

(22) PCT Filed: Aug. 23, 2000

(86) PCT No.: PCT/EP00/08194

§ 371 (c)(1),
(2), (4) Date: Feb. 4, 2002

(87) PCT Pub. No.: WO01/13762

PCT Pub. Date: Mar. 1, 2001

(30) Foreign Application Priority Data

Aug. 23, 1999 (WO) ..... PCT/EP99/06179

(51) Int. Cl.[7] ..... A47B 3/00
(52) U.S. Cl. ..... 108/132; 108/115
(58) Field of Search ..... 108/131, 132, 108/150, 123, 124, 115, 128, 122

(56) References Cited

U.S. PATENT DOCUMENTS 489,369 A * 1/1893 Case ..... 108/124
3,786,766 A 1/1974 Chiariello
4,178,858 A * 12/1979 Ponzellini ..... 108/150
5,205,223 A * 4/1993 Ball et al. ..... 108/115
5,337,657 A * 8/1994 Diffrient ..... 108/115
6,170,407 B1 * 1/2001 Hayward ..... 108/132
6,336,414 B1 * 1/2002 Stewart et al. ..... 108/50.02

FOREIGN PATENT DOCUMENTS

| | | |
|---|---|---|
| DE | 65233 | 11/1892 |
| EP | 0572772 A2 | 12/1993 |
| WO | WO 00/10426 | 3/2000 |

* cited by examiner

*Primary Examiner*—Lanna Mai
*Assistant Examiner*—Jerry A. Anderson
(74) *Attorney, Agent, or Firm*—Muramatsu & Associates

(57) ABSTRACT

A table with a pivotable table top for changing between a working position and a stacking position. The table has a table top and a table frame, wherein the table frame has a horizontal beam, at least one support part for supporting the table top and one or more table legs fixedly coupled to the support part, wherein the table top is hinged to the table frame so as to be pivotable about a horizontal pivot axis, and wherein the support part is movable transversely with respect to the pivot axis between the working position and the stacking position or is coupled to the beam so as to be pivotable about a vertical axis. Between the table top and the support part coupling means are provided which effect common pivoting or turning of the table top and of the table leg coupled to the support part.

11 Claims, 8 Drawing Sheets

Figure 1:
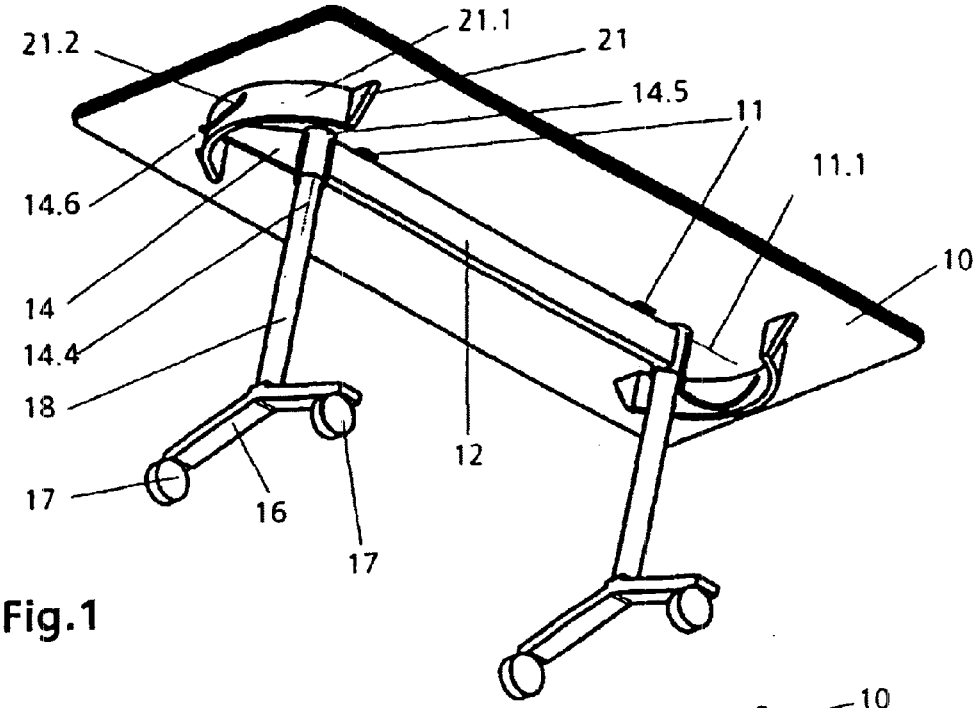

Fig.6
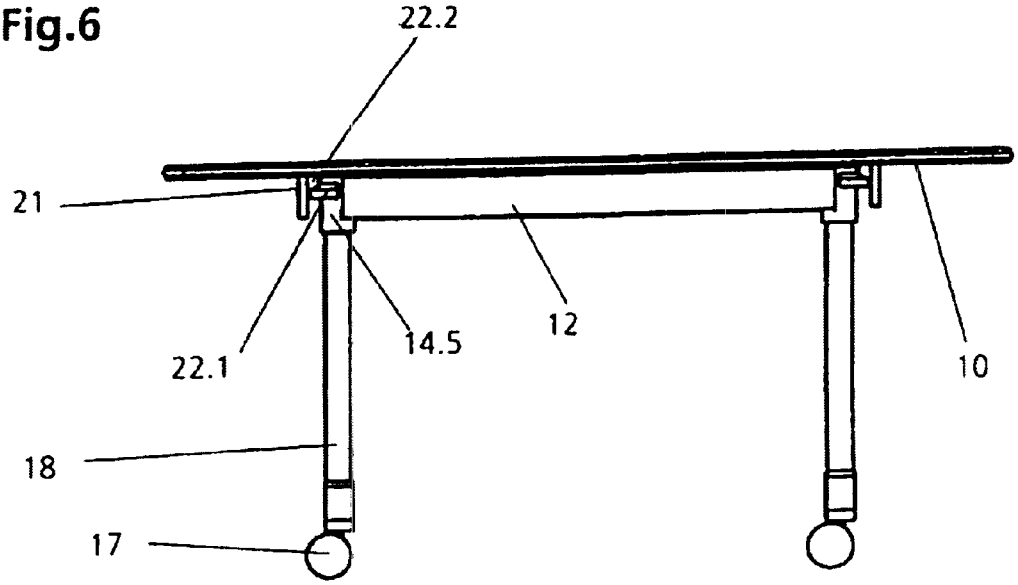
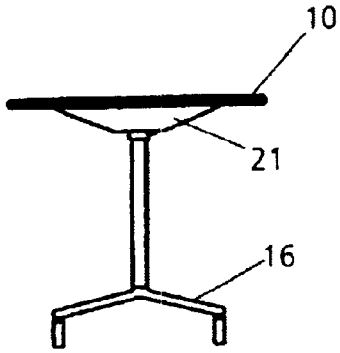
Fig. 7
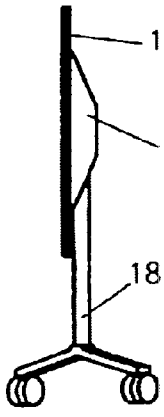
Fig. 9
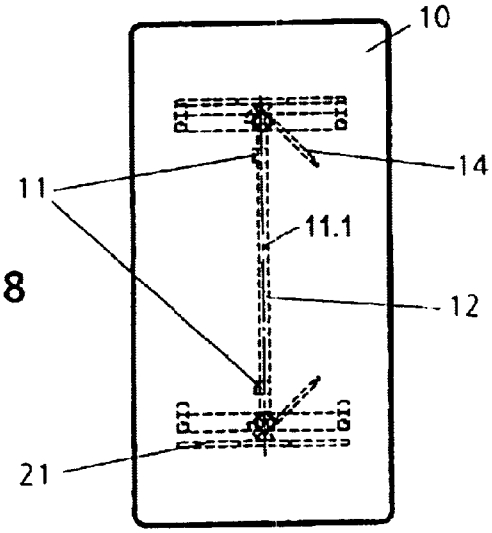
Fig. 8
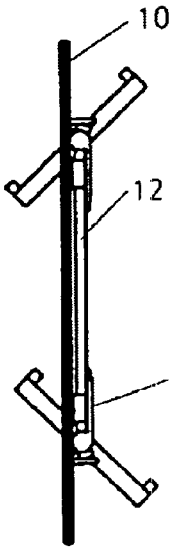
Fig. 10

TABLE WITH PIVOTABLE TABLE-TOP

The invention relates to a table with a table top and a table frame, wherein the table top is hinged on the table frame so as to be pivotable about a horizontal pivot axis. The table frame has a horizontal beam, at least one support part for supporting the table top and one or more table legs coupled to the support part. The support part is movable transversely with respect to the pivot axis between a working position and a stacking position or is coupled to the beam so as to be pivotable about a vertical axis.

Such tables are known for example as conference room tables. A different number of tables must be set tip depending upon the occupancy of a conference room. The tables which are not required are stacked to save space.

A table according to the preamble to Claim is known from EP-A-0 572 770. This table has two table legs which are constructed as vertical supporting struts and in the base region bear crossbars which are supported on the floor by way of feet. The crossbars of the table legs are parallel to one another in the working position of the table top and extend in the direction of the depth of the table. In order to bring this table from the working position into the stacking position, first of all both supporting struts must be folded inwards so that the table top can then be folded downwards. Two people are usually required for this operation.

The object of the invention, therefore, is to improve the table according to the preamble to claim 1 in such a way that it is also easily possible for one person to bring the table from the working position into the stacking position and vice versa.

This object is achieved by the features of claim 1.

Further embodiments of the invention are the subject matter of the subordinate claims.

According to the invention the table has a table top and a table frame, wherein the table frame has a horizontal beam, at least one support part for supporting the table top and one or more table legs coupled to the support part. The table top is hinged on the beam so as to be pivotable about a horizontal pivot axis, and the support part is movable transversely with respect to the pivot axis between a working position and a stacking position or is coupled to the beam so as to be pivotable about a vertical axis. Furthermore, between the table top and the support part coupling means are provided which effect common pivoting or turning of the table top and of the table leg coupled to the support part.

As a result, the table can be brought from the working position into the stacking position by simply folding down the table top, optionally after unlocking. In this case the table legs are automatically pivoted or turned with it. Conversely, by raising the table top the table can likewise be brought into the working position in a simple manner by one person.

In a special embodiment of the invention the table legs are constructed as vertical supporting struts which in the base region bear horizontal crossbars which are supported on the floor by way of feet or castors. In this case the crossbars are disposed outside the pivoting range of the table top and in the working position of the table top they are parallel to one another and extend in the direction of the depth of the table, whilst in the stacking position they are disposed at an angle following the movement of the support parts relative to one another.

The angular position of the crossbars in the stacking position ensures that in this position also the table can stand up by itself with the table top folded down. If the crossbars are provided with castors, the table can also be moved in a simple manner in the stacking position. Furthermore, the angular position of the crossbars also ensures that in the stacking position a plurality of tables can be pushed into one another or placed one behind the other, resulting in a very space-saving arrangement of the tables in the stacking position.

Further embodiments and advantages of the invention are explained in greater detail below with reference to the description of several embodiments and to the drawings.

Figure 2:
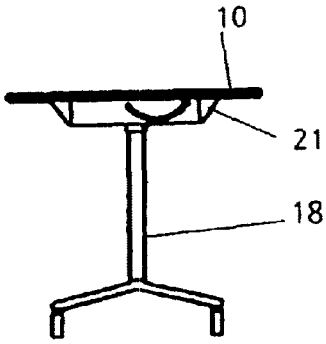
Figure 4:
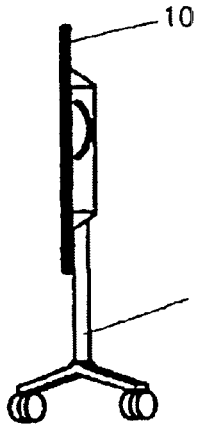
Figure 3:
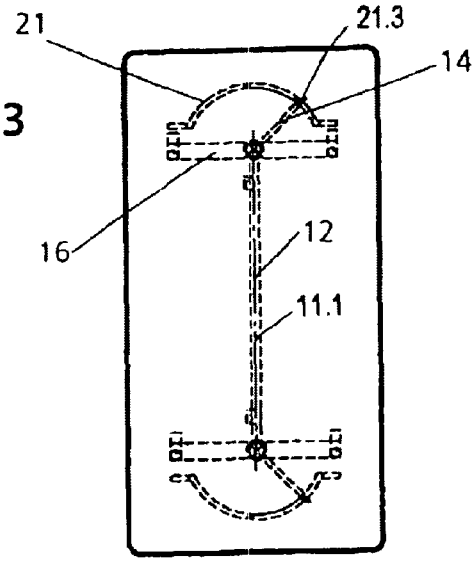
Figure 5:
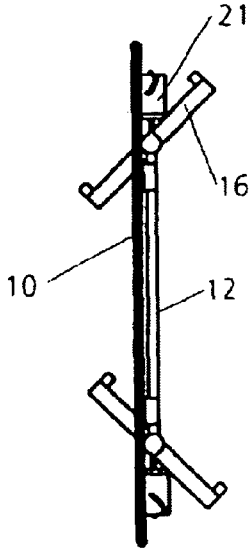
Figure 11:
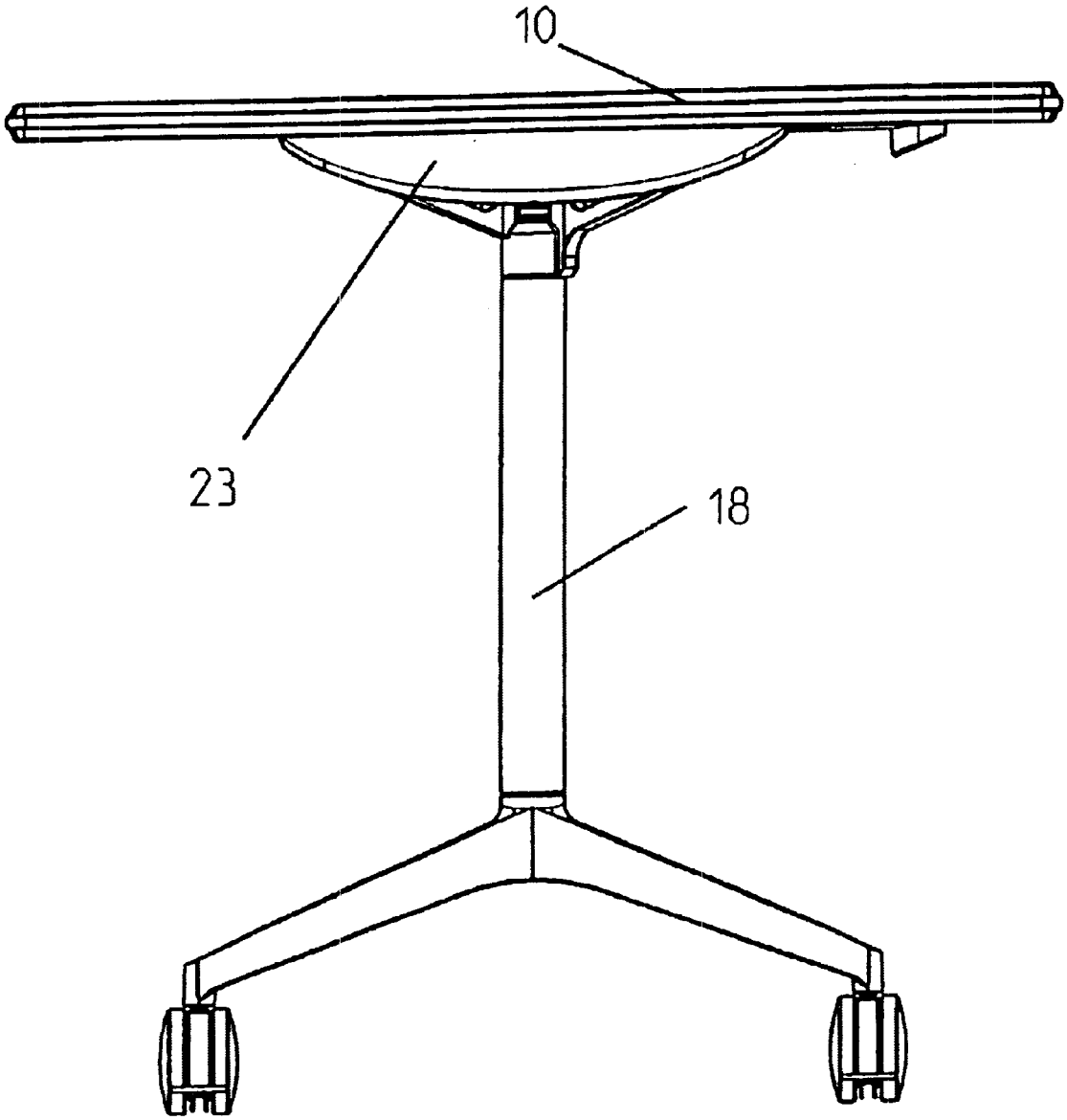
Figure 12:
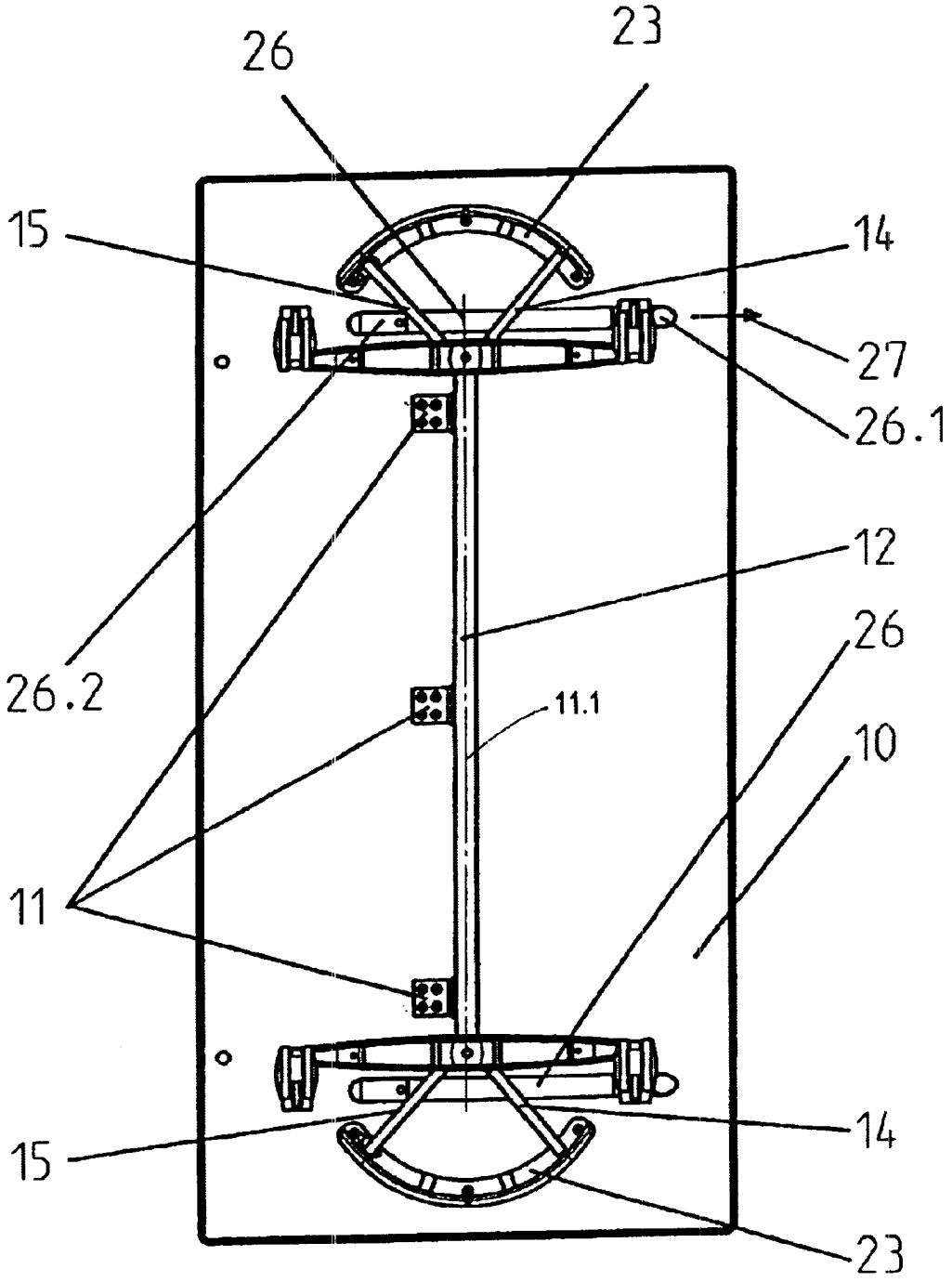
Figure 13:
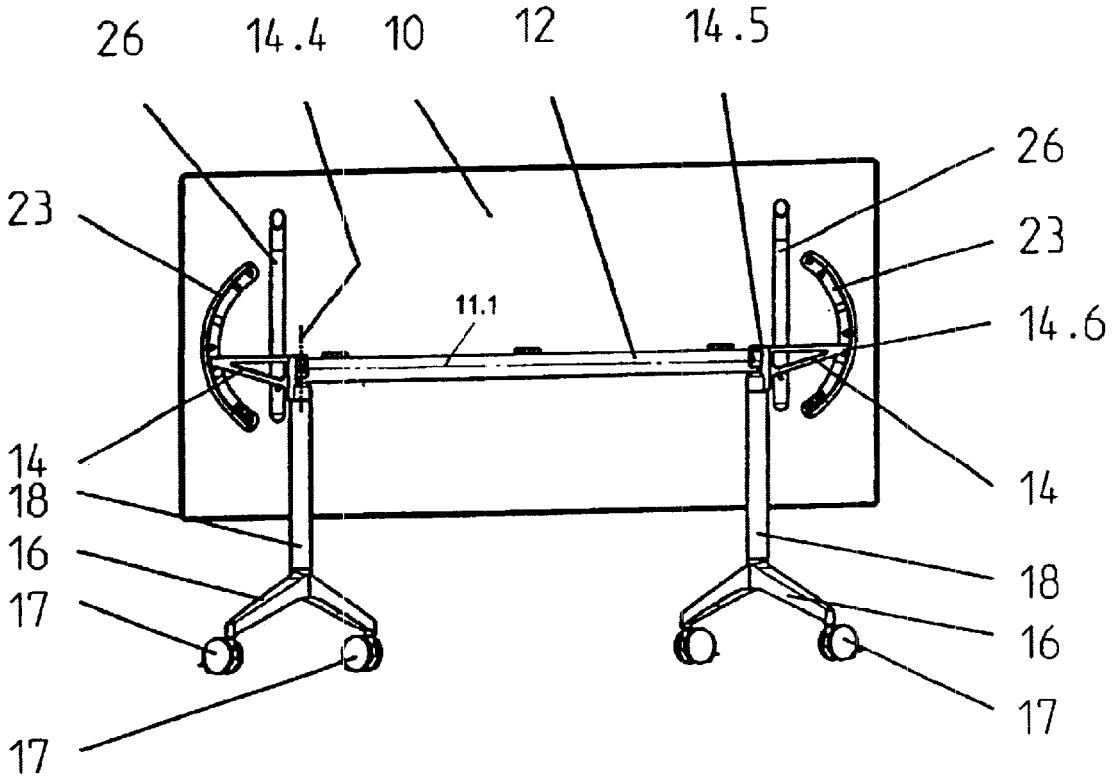
Figure 14:
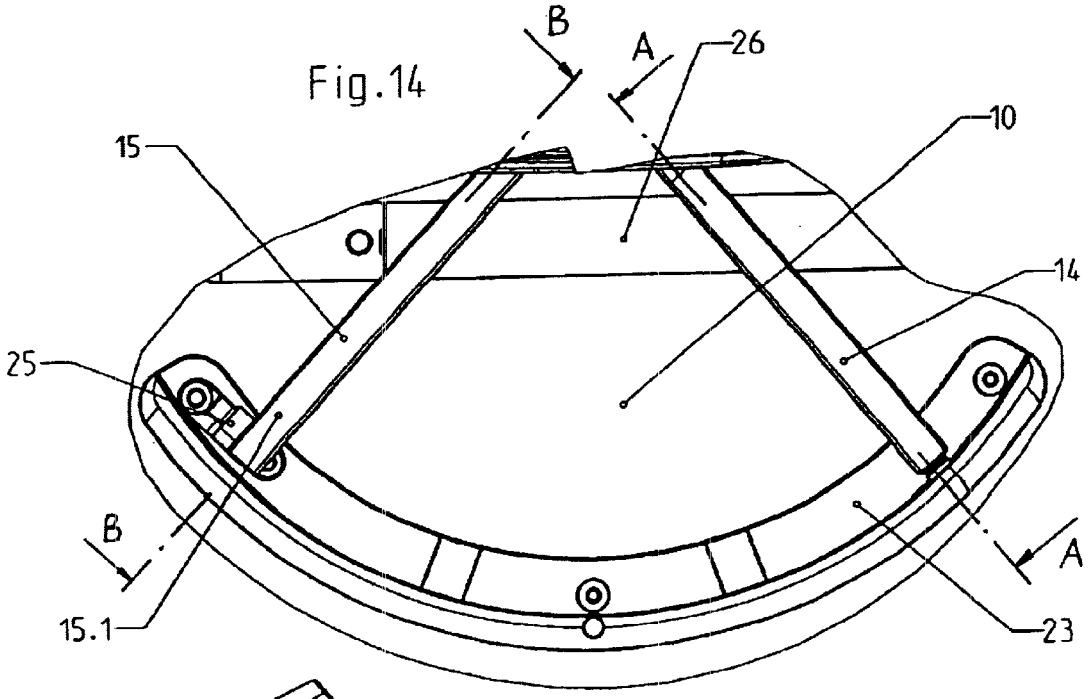
Figure 15:
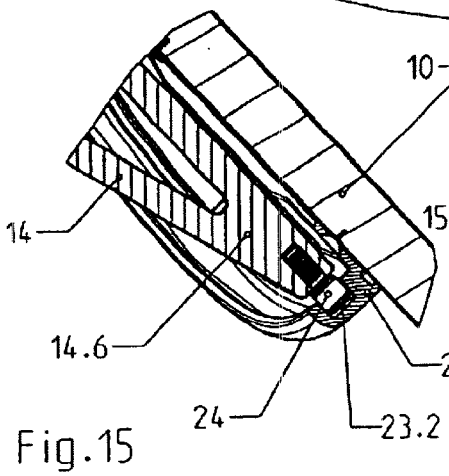
Figure 16:
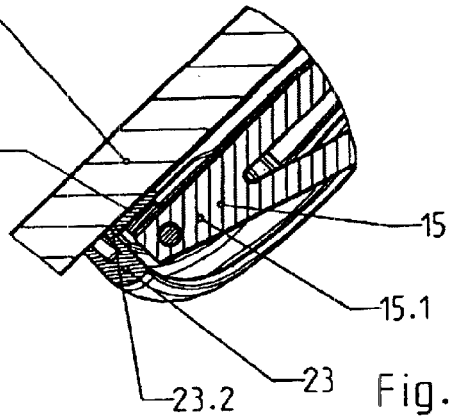
Figure 17:
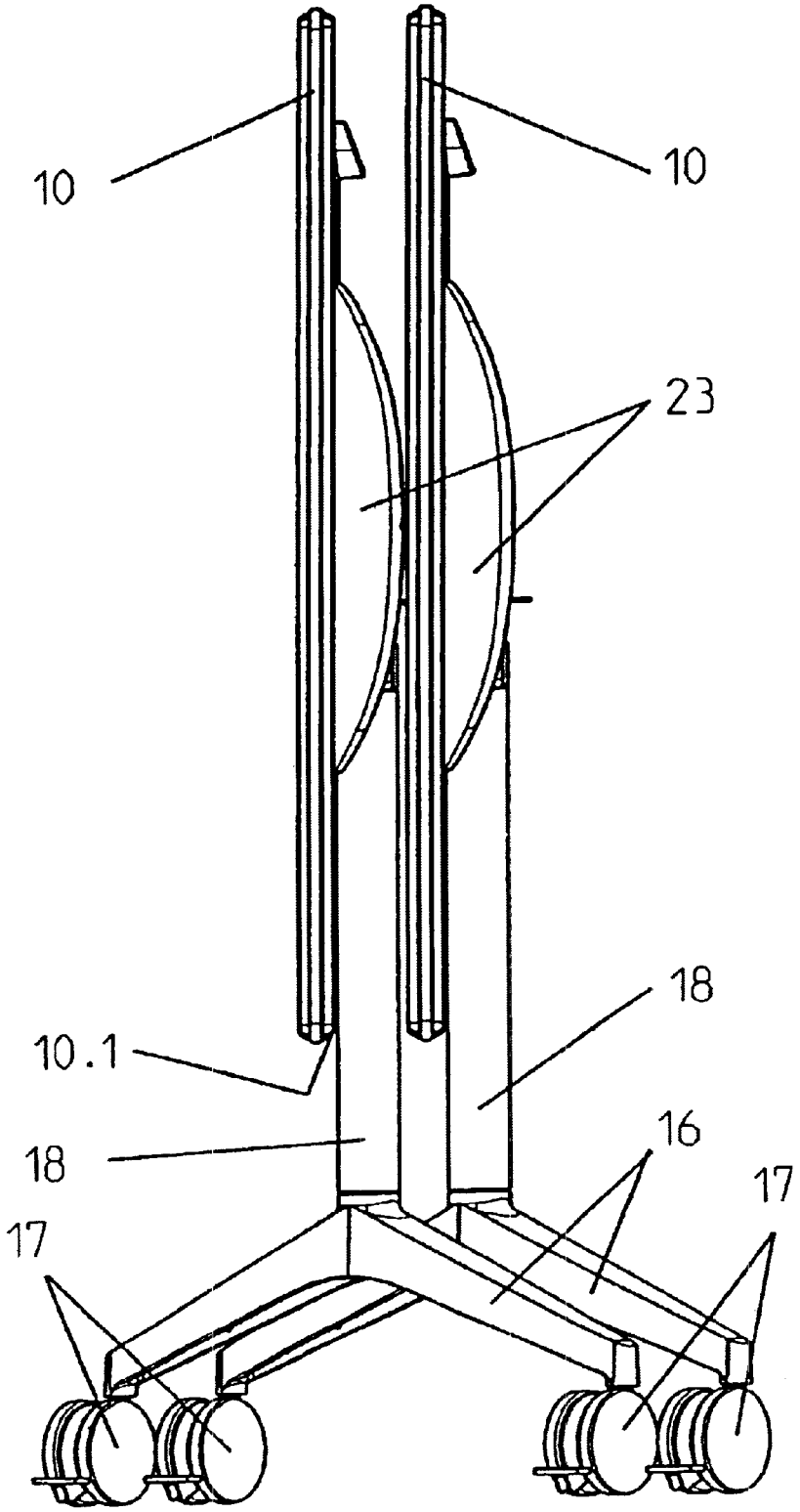
Figure 18:
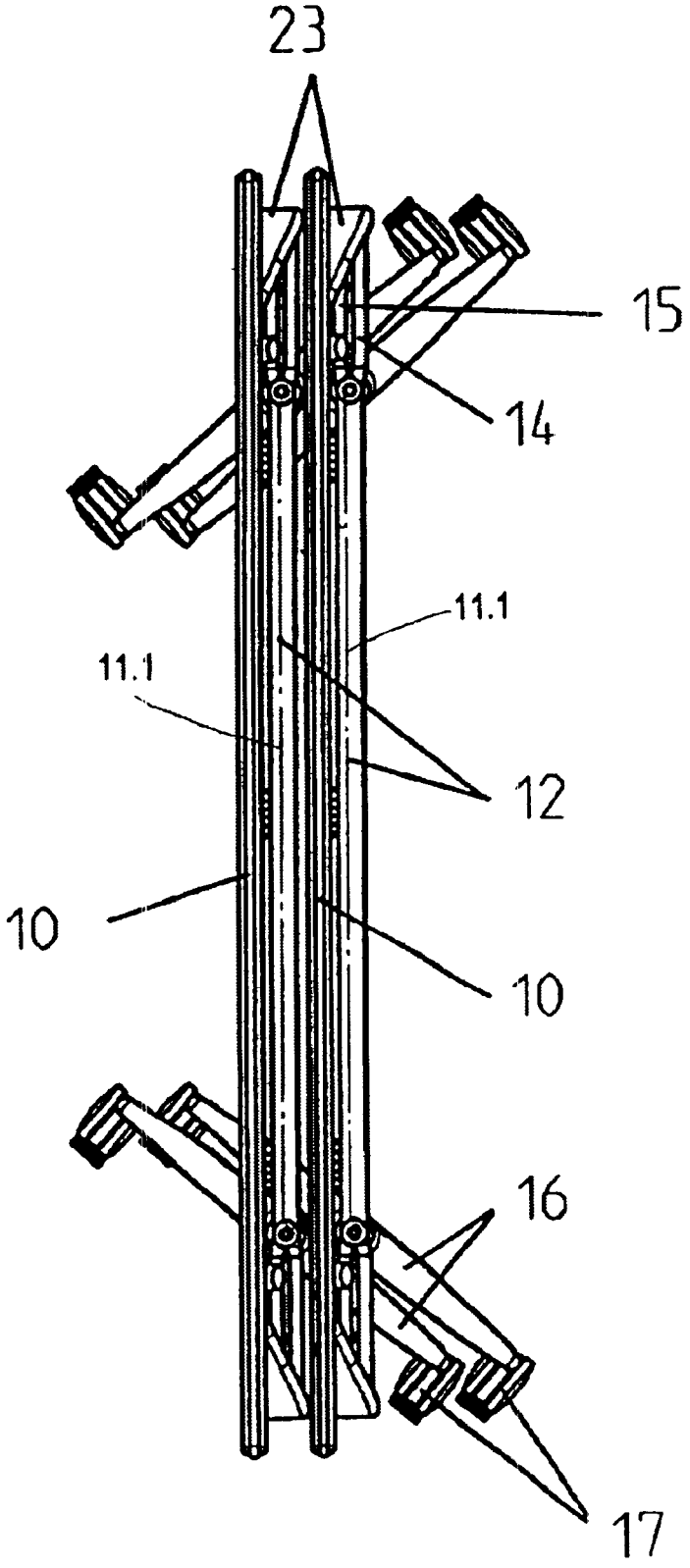

In the drawings:

FIG. 1 shows a three-dimensional partial view of the table according to a first embodiment, FIG. 2 shows a schematic side view of the table according to FIG. 1 in the working position, FIG. 3 shows a schematic view from below of the table according to FIG. 1 in the working position, FIG. 4 shows a schematic side view of the table according to FIG. 1 in the stacking position, FIG. 5 shows a schematic top view of the table according to FIG. 1 in the stacking position, FIG. 6 shows a three-dimensional partial view of the table according to a second embodiment, FIG. 6 shows a three-dimensional partial view of the table according to a second embodiment, FIG. 7 shows a schematic side view of the table according to FIG. 6 in the working position, FIG. 8 shows a schematic view from below of the table according to FIG. 6 in the working position, FIG. 9 shows a schematic side view of the table according to FIG. 6 in the stacking position, FIG. 10 shows a schematic top view of the table according to FIG. 6 in the stacking position, FIG. 11 shows a side view of a table in the working position according to a third embodiment, FIG. 12 shows a view from below of the table according to FIG. 11 in the working position, FIG. 13 shows a rear view of the table according to FIG. 11 in the stacking position, FIG. 14 shows a detail according to FIG. 12 in the region of the support elements, FIG. 15 shows a sectional representation along the line A—A in FIG. 14, FIG. 16 shows a sectional representation along the line B—B in FIG. 14, FIG. 17 shows a side view of two e stacked in one another, FIG. 18 shows a top view of two tables stacked in one another.

A first embodiment is shown in FIGS. 1 to 5. The table essentially consists of a table top 10 and a table frame, the table top being hinged on the table frame so as to be pivotable about a horizontal pivot axis 11.1. The table frame has a horizontal beam 12, at least one support part 14 for supporting the table top 10 and one or more table legs non-rotatably coupled to the support part. The support part 14 is coupled to the beam 12 so as to be movable transversely with respect to the pivot axis 11.1 or pivotable about a vertical axis 14.4 between a working position (FIGS. 2, 3) and a stacking position (FIGS. 4, 5). The table top 10 is pivotably hinged on the beam 12 by way of hinges 11.

The table also has a transverse support 21 which is disposed transversely with respect to the beam 12 and has a groove 21.2 in a central portion 21.1 which is curved in an approximately arcuate shape.

The support part 14 is constructed in the manner of an outrigger and is held with its end 14.5 articulated on the beam 12, whilst the other end 14.6 is guided in the groove 21.2 in the transverse support 21. In this case the end 14.6 is for example constricted as a guide lug of a guide roller. At least in the working position of the table a suitable locking means should be provided in order to fix the end 14.6 of the support element 14 releasably at one end of the groove 21.2. This can be effected for example by a corresponding shaping of the groove or other means.

In the working position of the table the support part 14 is oriented at an angle of for example 45° to the extension of the beam 12.

The table leg 18 is provided in its lower region with a crossbar 16 which in turn has feet or castors 17. In the working position of the table the crossbar is oriented substantially perpendicular to the beam 12 (see FIG. 3). Since the table leg 18 is rigidly connected to the support element 14, the crossbar 16 is correspondingly moved during a pivoting movement of the support part 14. In the stacking position the two opposing crossbars are oriented in a V shape relative to one another (see FIG. 5). In this position a plurality of tables can be stacked in one another to save space. Such stacking is particularly simple when the crossbars are provided with castors 17, so that the folded tables can be moved without effort.

In FIGS. 6 to 10 a second embodiment is shown in which coupling means which effect a common pivoting or turning of the table top and table leg are again provided between the table top and the support part.

For corresponding parts the same reference numerals as in FIG. 1 are used.

Here too the table top 10 is pivotably mounted on the beam 12 by way of hinges 11. The support part 14 is again articulated by its end 14.5 on the beam 12. The table leg 18 is also fixed on this end 14.5.

The coupling means for common pivoting of the table top and support part are formed in the illustrated embodiment by toothed wheels, particularly by two mitre wheels 22.1, 22.2. One mitre wheel 22.1 is fixed to the support element 14 in the region of its end 14.5, whilst the other mitre wheel 22.2, which engages with the other mitre wheel 22.2, is fixed on the transverse support 21 or on the table top 10.

Since the forces acting on the table top 10 cannot be absorbed solely by the mitre wheels, the support part 14 is constructed as a outrigger on which the table top can be supported (see FIG. 8). In this case the outrigger should be releasably locked in a suitable manner in the working position of the table.

In the working position the support element 14 is oriented at an angle to the beam 12. However, if the table top 10 is pivoted into the stacking position (FIG. 10) the support element 14 and the beam 12 are parallel to one another. Due to the pivoting of the support element 14 the table leg is also turned, so that the crossbar 16 in turn assumes an angle of approximately 45° relative to the table top 10 and thus requires less stacking space.

A third, preferred embodiment is described below with reference to FIGS. 11 to 18. Here too the same reference numerals are used for the same parts.

The table consists essentially of a table top 10 and a table frame which has a horizontal beam 12, at least one support part 14 for supporting the table top and one or more table legs 18 coupled to the support part. The table top 10 is hinged on the beam 12 by way of hinges 11 so as to be pivotable about a horizontal pivot axis. The support part 14 is coupled to the beam 12 so as to be movable transversely with respect to the pivot axis or pivotable about a vertical axis 14.4 between a working position (FIG. 11) and a stacking position (FIG. 13).

Between the table top 10 and the support part 14 coupling means are also provided which effect a common pivoting or turning of the table top 10 and of the table leg 18 coupled to the support pale 14. In this embodiment these coupling means are constructed in such a way that the support part 14 articulated by one end 14.5 on the beam 12 is guided with its other end 14.6 in a guide profile 23 fixed on the table top 10. The guide profile is constructed as a frame and has a guide groove 23.2 in which the end 14.6 of the support part 14 is guided by means of a suitable bearing 24.

As can be seen in particular from FIG. 12, a first support part 14 is articulated on each end of the beam 12, each first support part being connected to a table leg 18. In addition to the first support part 14 a second support part 15 is also provided which is likewise pivotable about the vertical axis 14.4, but independently of the first Support part 14. This second support part 15 is likewise in contact with the guide profile 23 by its end 15.1 which is opposite the vertical axis 14.4. The end 15.1 of the second support part 15 is provided on its upper face facing the table top 10 with a suitable bearing 15.2 which co-operates with a corresponding guide track 23.2 on the guide profile 23. The bearing 15.2 can be formed for example by a roller bearing which can roll on the guide track 23.2.

As can be seen in particular from FIG. 12, the first support part 14 and the second support part 15 are disposed approximately in the shape of a V relative to one another in the working position of the table. In addition to supporting the table top 10, the first support part 14 also serves as a connecting member between the table top 10 and the table legs 18 in order to effect the synchronized turning of the legs when the table top is being folded down. The second support part 15 serves essentially for the additional support of the table top and in this embodiment also has the function of locking the table top in the working position.

The second support part 15 is also biased by a spring element, which is not shown in further detail, in such a way that it moves automatically from the stacking position into the working position as soon as the table top is oriented horizontally. At the end of its movement the end 15.1 of the second support part 15 comes into locking contact with a locking mechanism 25 which is merely indicated schematically.

Thus the first support part 14 moves during the entire process of pivoting the table top from the stacking position to the locking position of the support element. On the other hand, the second support element 15 is only pivoted out automatically due to the spring element when the table top has been brought into the horizontal working position. For unlocking of the locked second support element 15 an unlocking mechanism 26 is provided which is indicated schematically in FIG. 12, 13 and 14 and is in operative connection with the locking mechanism 25.

The unlocking mechanism 26 has for example on its one end 26.1 a suitably constructed handle with the aid of which the unlocking mechanism can be moved in the direction of the arrow 27 (FIG. 12). During the movement in the direction of the arrow 27 an entrainment lug 26.2 comes into contact with the second support part 15 and takes it with it.

In the stacking position of the table the two support parts 14 and 15 lie approximately parallel to one another and in the extension of the beam 12. However, within the scope of the invention it is also conceivable that the locking mechanism 25 is constructed as a simple, optionally damped stop on which the extended second support part 15 rests and is held by the spring (not shown). The unlocking mechanism could then be configured in the manner described above, so that it simply has the function of entraining the second support part 15 in order to facilitate pivoting of the table top.

The table legs 18 are constricted as vertical supporting struts which have in their base region crossbars 16 which are supported on the floor by way of feet or castors 17. In this case the crossbars 16 are disposed outside the pivoting range of the table top 10, i.e. the lower edge 10.1 of the folded-down table top ends above the crossbars 16, as shown in FIG. 17.

The crossbars are constructed so as to be substantially horizontal, i.e. transverse with respect to the table legs 18. In the illustrated embodiment the table has two legs which are each disposed at one end of the beam 12.

FIG. 12 shows that in the working position of the table top 10 the crossbars 16 of the table legs 18 extend parallel to one another and in the direction of the depth of the table. In the stacking position shown in FIGS. 17 and 18 it can be seen that the crossbars are at an angle due to the movement relative to one another by the support parts 14. Thus each crossbar is for example at an angle of approximately 45° to the table top.

Due to this angular position the table can also still stand by itself with the table top 10 folded down, without this making more stowage room necessary when a plurality of tables are stacked in one another. In the top view according to FIG. 18 the obliquely positioned crossbars doe project beyond the table top, but nevertheless tables which are stacked in one another can be stacked in one another so that they butt directly against one another.

The various embodiments of the table which are described above are distinguished by the fact that they can be brought from the working position into the stacking position and vice verse without problems by one person, since due to the coupling means a synchronised turning of the table legs with crossbars is effected when the table top is being pivoted. In combination with the facility for the table to stand by itself with the table top folded down, a further simplification is provided. If the tables also have castors, then even in the case of relatively large dimensions the tables can be closed or folded tip and moved easily by one person.

What is claimed is:

1. A table, comprising:

a table frame having a horizontal beam;

at least one support part connected to one end of the horizonal beam;

one or more table legs fixedly coupled to the support part;

a table top supported by the support part and is hinged to the table frame so as to be pivotable about a horizontal pivot axis; and coupling means provided between the table top and the support part for pivoting the table top and turning the table leg coupled to the support part at the same time;

wherein the support part is movable transversely with respect to the pivot axis between a working position and a stacking position, and is coupled to the horizontal beam so as to be pivotable about a vertical axis at the end of the horizontal beam.

2. A table as claimed in claim 1, wherein the coupling means are constructed in such a way that the support part pivotally connected to one end of the horizontal beam is guided at its other end by a guide profile formed on a bottom surface of the table top.

3. A table as claimed in claim 2, wherein the guide profile is formed by a frame which has a guide groove for guiding the support part when pivoting about the vertical axis.

4. A table as claimed in claim 1, wherein the support part is held with one end of the horizontal beam and the other end is releasably attached to a locking means in the working position of the table.

5. A table as claimed in claim 1, wherein at least one pivotable support part is provided at each end of the horizontal beam.

6. A table as claimed in claim 1, wherein first and second pivotable support parts are provided at each end of the beam.

7. A table as claimed in claim 1, wherein first and second pivotable support parts are provided at each end of the beam, wherein said support parts are pivotable about a common axis and disposed approximately in the shape of a V relative to one another in the working position of the table.

8. A table as claimed in claim 6, wherein the second support part is moved automatically from the stacking position to the working position.

9. A table as claimed in claim 1, wherein the coupling means are formed by toothed wheels, particularly by mitre wheels.

10. A table as claimed in claim 1, wherein the table legs are constructed as vertical supporting struts, comprising horizontal crossbars which are supported on the floor by way of feet or castors, and wherein the crossbars are placed at the height so that the table top does not hit the crossbars when the table top is folded down.

11. A table as claimed in claim 10, wherein in the working position of the table top the crossbars of the table legs are parallel to one another and are rotated about the transverse axis to the surface of the table in such that the angle between the crossbar and the horizontal beam is orthogonal, and in the stacking position, the crossbar are rotated in the opposite direction to the rotation in the working position so that the crossbar and horizontal beam becomes minimum amount of the angle which is determined in the mechanical configuration in the stacking position, following the movement of the support parts keeping in parallel one another.

* * * * *